United States Patent [19]

Potter

[11] 4,437,589

[45] Mar. 20, 1984

[54] DISPENSING CARTRIDGE

[75] Inventor: Charles Potter, Stow, Ohio

[73] Assignee: Go-Jo Industries, Inc., Cuyahoga Falls, Ohio

[21] Appl. No.: 401,856

[22] Filed: Jul. 23, 1982

Related U.S. Application Data

[63] Continuation of Ser. No. 177,269, Aug. 11, 1980, abandoned.

[51] Int. Cl.[3] ..... B65D 88/54

[52] U.S. Cl. ..... 222/327; 220/93; 220/276

[58] Field of Search ..... 222/326–327, 222/386, 390; 220/93, 276–278, 89 A; 206/384

[56] References Cited

U.S. PATENT DOCUMENTS

| | | | |
|---|---|---|---|
| 1,636,407 | 7/1927 | Brommer | 206/384 |
| 1,941,139 | 12/1933 | Creveling | 206/384 |
| 2,090,111 | 8/1937 | Creveling | 222/386 |
| 2,131,487 | 9/1938 | Tear | 222/327 |
| 2,815,994 | 12/1957 | Lippman et al. | 309/23 |
| 2,941,699 | 6/1960 | Schmidt et al. | 222/327 |
| 3,161,325 | 12/1964 | Hinkel et al. | 222/327 |
| 3,273,741 | 9/1966 | Faunce | 220/93 |
| 4,256,241 | 3/1981 | Mesic | 222/325 |

*Primary Examiner*—H. Grant Skaggs
*Attorney, Agent, or Firm*—Reese Taylor

[57] ABSTRACT

Improved dispensing cartridges for use in combination with a dispenser to distribute high viscosity material, such as soap, for example, include an integral but removable bottom wall which serves the dual purpose of acting as the bottom of a container during transportation of the cartridge and acting as a pressure plate in response to atmospheric pressure to assist dispensing of the material when the cartridge is installed on the dispenser and the bottom wall is detached. A modified form of the invention is designed to be utilized selectively with either free running dispensers or with dispensers which include a screw operated pressure plate and includes a centrally disposed removable section in the bottom wall.

3 Claims, 9 Drawing Figures

DISPENSING CARTRIDGE

RELATED APPLICATIONS

This application is a Continuation of Applicant's earlier file Application Ser. No. 177,269, filed Aug. 11, 1980 and now abandoned.

BACKGROUND OF THE INVENTION

This invention relates, in general, to dispensers of the type wherein the dispenser is a more or less permanent fixture attachable to a supporting surface and receives disposable cartridges. The invention relates in particular to dispensers of this general nature in which the material to be dispensed is a high viscosity material, such as soap.

DESCRIPTION OF THE PRIOR ART

In general, the prior art known to Applicant involves utilization of dispensing combinations which essentially consist of two components. The first component is the dispenser itself, which is generally a plastic or metal mechanism intended to be more or less permanently installed on a supporting surface, such as a wall. The second component is a "cartridge," which is essentially a container filled with the material and intended to be disposable in nature and to be insertable on the permanent dispensing unit.

More specifically, one type of dispensing unit known to Applicant employs a hand-operated arm or lever which pumps out a predetermined amount of the material. This is a spring-loaded reciprocal arm and is moved by hand pressure to open and close a valve to permit metered amounts of the material to pass out of a nozzle. The cartridge is essentially a cylindrical container having a bottom and a removable top cap. To affix the cartridge to the dispenser, normally the cap would be removed and the cartridge would be inverted into a suitable receptacle on the dispenser.

However, in order for the material to flow suitably when the cartridge is installed on the dispenser, it is necessary to provide an aperture in the bottom wall of the container and then insert a follower or pressure plate. Following that, the container is filled with the material and the top cap is affixed.

Once this type cartridge has been placed on the dispenser, a combination of atmospheric pressure acting through the aperture in the bottom wall and on the pressure plate and the pumping action of the dispenser itself will provide a measured amount of material to the user.

A second version of the prior art includes a fixed dispensing member. However, here the dispensing member includes a threaded center post and a ratchet-gear arrangement. A pressure plate is carried on the threaded rod, which is actuated by the ratchet gearing from the handle. This draws the pressure plate down onto the material and forces it out of a dispensing valve. An example of this type dispenser can be seen in Lippman et al U.S. Pat. No. 2,815,994.

The cartridge used with this type of dispenser in the past has been a metal cylindrical cartridge which has a knock-out plug centrally disposed in its bottom wall so that the cartridge, once its lid has been removed, could be inserted over the threaded shaft, following which, of course, actuation of the handle and working of the ratchet gearing permits the pressure plate to be drawn down and force the material out of the dispensing nozzle or valve.

While dispensing combinations of this type are generally satisfactory, there are some disadvantages.

First of all, with regard to the first, or more or less free flowing assembly described above, there are certain manufacturing steps which are necessary and which add to the cost of the cartridge. First, it is necessary, once the container has been molded, to perforate the bottom wall, and second, it is necessary to insert the pressure plate. Following this, the container is filled and the cap applied.

Furthermore, with regard to the second type of dispenser, it has been found that a universal bottom arrangement can be provided so that a given cartridge could be capable of use with either of the type of dispensers generally in use and described above.

BRIEF DESCRIPTION OF THE INVENTION

Accordingly, it has been found that by forming the bottom wall of the cartridge so that a relatively thin web of material is disposed around its circumference adjacent its point of juncture with the sidewalls, that the need for a separate pressure plate can be totally eliminated. It has been discovered that, in this fashion, the container can be formed by the usual molding process, filled with the material, and capped. When it is desired to use the improved cartridge, it is merely necessary to remove the cap and invert the cartridge onto the dispenser, following which the periphery of the thin web can be penetrated with a knife or other suitable device and the bottom wall then becomes the pressure plate. The cap can then be placed on the bottom end of the container and will permit enough air to enter to work on the pressure plate.

By this means, therefore, the steps of separately inserting a separate pressure plate prior to filling the cartridge and perforating the bottom wall are eliminated. Therefore, at least two production steps are eliminated without, in any way, impairing the operative effectiveness of the finished product. Furthermore, savings of economy are achieved by elimination of the separate pressure plate.

With regard to the second type of dispenser above described, it has been found that the same type of removable bottom wall can be formed on the cartridge and that a reduced diameter centrally located knock-out plate can also be provided and attached to the bottom wall by a reduced thickness web. In this fashion, it is possible to utilize the same cartridge either with the first or the second types of dispensers described above as desired.

Accordingly, production of an improved dispenser apparatus of the type above-described becomes the principal object of this invention with other objects thereof becoming more apparent upon a reading of the following brief specification, considered and interpreted in view of the accompanying drawings.

OF THE DRAWINGS

BRIEF DESCRIPTION OF THE PREFERRED EMBODIMENTS

Figure 1:
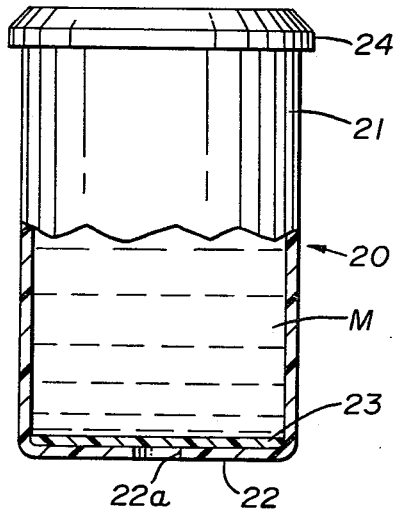
FIG. 1 PRIOR ART
FIG. 1 is an elevational view of a prior art cartridge.
Figure 2:
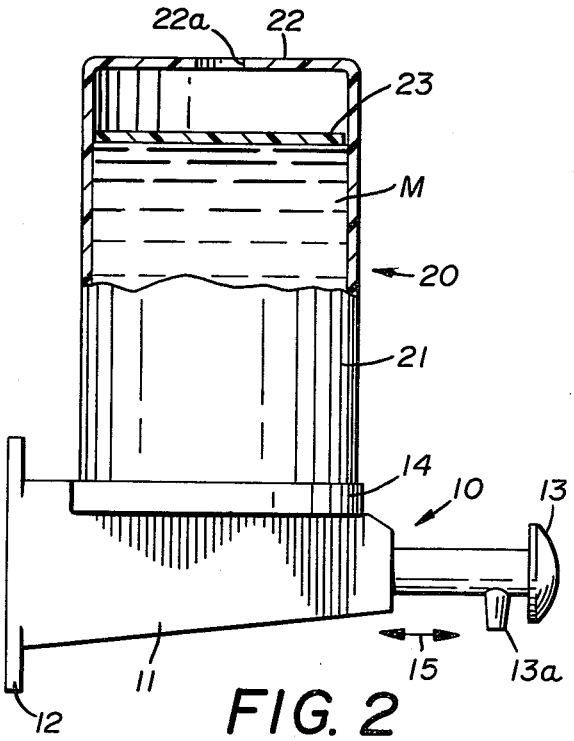
FIG. 2 PRIOR ART
FIG. 2 is an elevational view of a prior art cartridge installed on a dispenser.

Referring first then to FIGS. 1 and 2 of the drawings, one form of the prior art is illustrated.

In this prior art structure, the cartridge, generally indicated by the numeral 20, includes a cylindrical body 21 and integral bottom 22. A pressure plate 23 is received within the body 21 and the top cap 24 is employed to close off the end opposed to the bottom wall 22.

As noted above, in filling or assembling a cartridge of this nature, it is first necessary to mold the body 21 with the integral bottom wall 22. It is then necessary to perforate the wall 22 as at 22*a* and to insert the pressure plate 23. Following that, it is possible to fill the cartridge with the material M and apply the closure cap 24.

This type of cartridge can be used with one type of the prior art dispenser, and it will be noted that the dispenser, generally indicated by the numeral 10, includes a body 11 and a mounting flange 12. Furthermore, a spring-loaded pump arm 13 is provided and reciprocates in the direction of the arrow 15. On the top of the body 11 is a circular flange 14, which is intended to receive the cartridge 20. No substantial detail has been illustrated or described herein with regard to the dispenser 10 since it is well known in the art.

However, with reference to FIG. 2, it will be noted that the cartridge 20, once the cap 24 has been removed, can be inverted and placed into the flange 14. Following that, reciprocation of the pump arm 13 in the direction of the arrow 15 to actuate a valve (not shown), together with the atmospheric pressure entering through the aperture 22 and acting on pressure plate 23, will permit a measured amount of the material M to be dispensed through the nozzle 13*a*.

Figure 3:
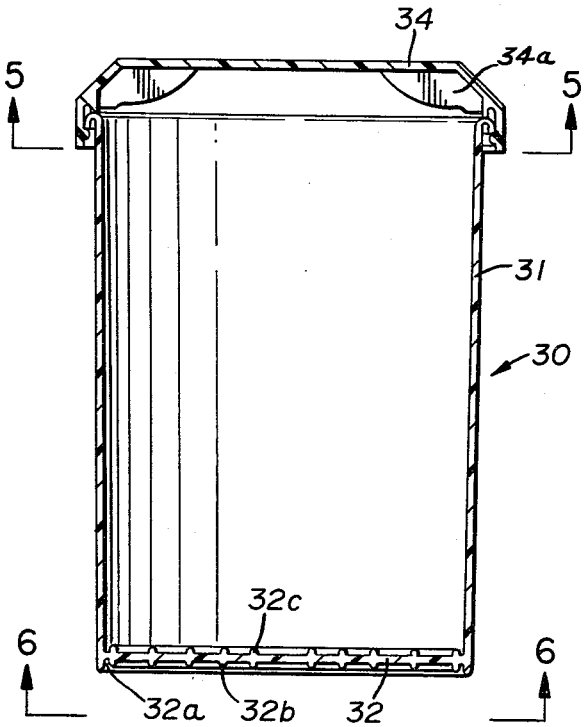
FIG. 3 is a sectional elevational view of the improved cartridge.

In FIG. 3, the improved cartridge of the present invention is illustrated and generally indicated by the numeral 30. This cartridge, again, has an elongate molded cylindrical body 31 and an integral bottom wall 32. However, the bottom wall 32 of the improved cartridge 30 has a reduced thickness web 32*a* extending circumferentially around its periphery and disposed adjacent to its point of juncture with the sidewall of body 31. Reinforcing ribs 32*b* and 32*c* are also optionally provided. Furthermore, this form of the invention again includes the closure cap 34 removably attached to the opposed end of the body. This cap includes thin reinforcing ribs 34*a* and normally engages the rolled edge of the body 31.

Figure 4:
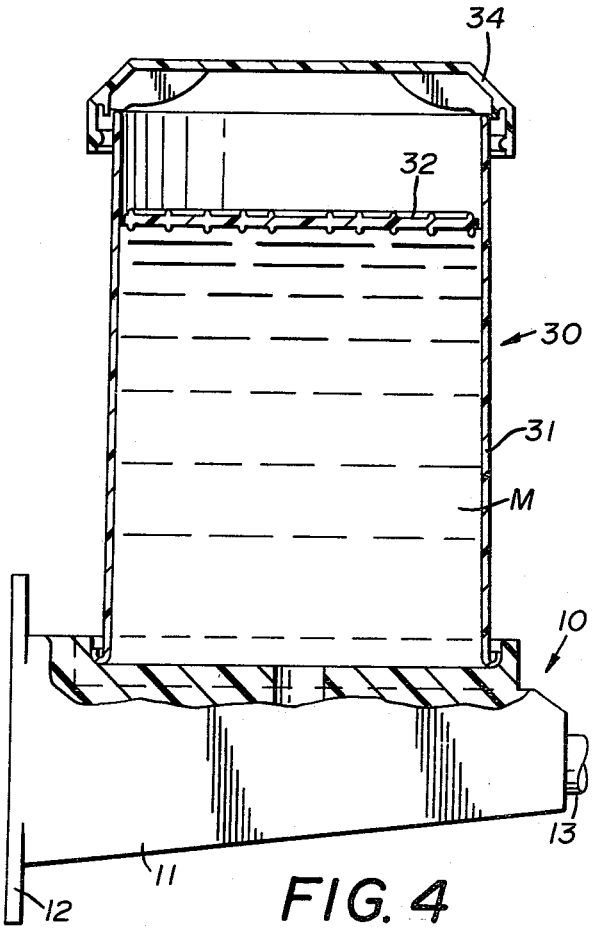
FIG. 4 is a partial sectional elevational view of the improved cartridge installed on a dispenser.
Figure 5:
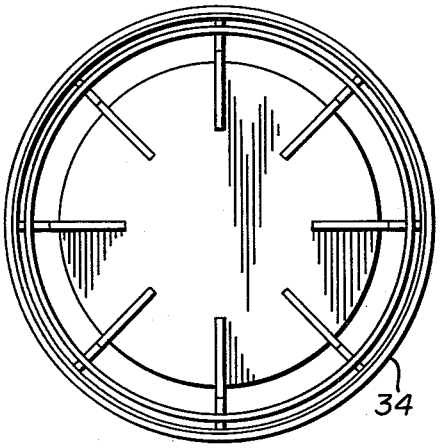
FIG. 5 is a sectional view taken along the lines 5—5 of FIG. 3.

Referring to FIG. 4, it will be noted that the improved cartridge 30 is illustrated as being in position on the prior art dispenser 10. This is accomplished by removing the closure cap 34 and inverting the cartridge 30 to fit into the circular receiving flange 14 of the dispenser 10. At that point, the web 32*a* is penetrated so that the bottom wall 32 is severed from the body 31 and becomes, in effect, the pressure plate. The closure cap 34 is placed on what was formerly the bottom of the container with ribs 34*a* resting on the edges of the cartridge wall and fits tightly enough so as to permit air to pass into the cartridge body 31 and act on the pressure plate 32. If necessary, ribs 34*a* can be relieved to facilitate movement of the air.

Again, once this has been accomplished, actuation of the pump arm 13 will permit the material M to be dispensed through the nozzle 13*a*.

In comparing the prior art cartridge 20 with the improved cartridge 30, it will be apparent that both will cooperate with dispenser 10 to form an operative combination. However, it is also apparent that labor savings are achieved since the steps of perforating the bottom wall and positioning the pressure plate are eliminated. Also, it is evident that a savings of material is achieved by eliminating the separate pressure plate.

Figure 7:
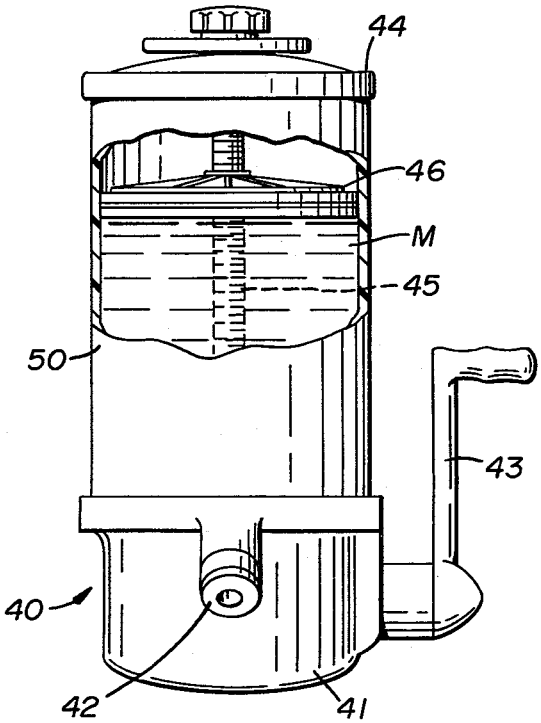
FIG. 7 is an elevational view, partially broken away, showing a modified form of dispenser and the cartridge of the invention in place thereon.
Figure 9:
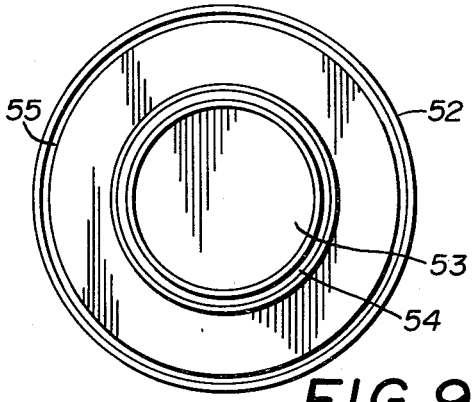
FIG. 9 is a view taken along the line 9—9 of FIG. 8.
Figure 8:
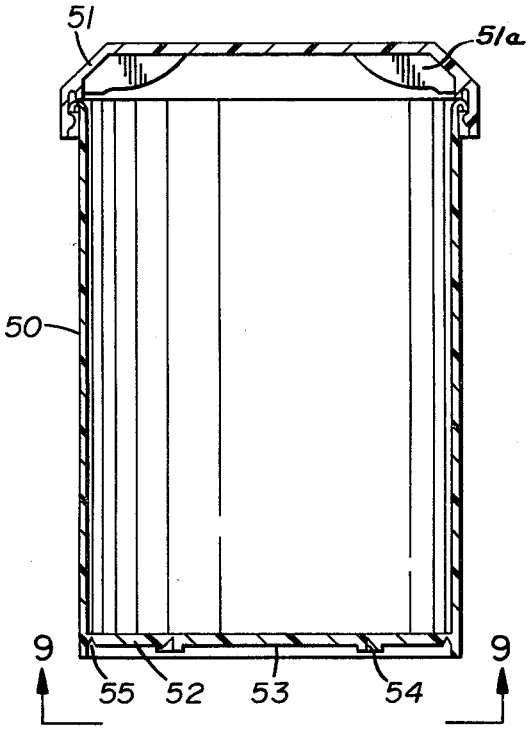
FIG. 8 is a sectional elevational view of the modified cartridge.

FIGS. 7 through 9 disclose a modified form of the invention.

In this form of the invention, a different type of dispenser, generally indicated by the numeral 40, is employed. This dispenser has not been shown in great detail because it is believed to be fully disclosed in Lippman et al U.S. Pat. No. 2,815,994.

Suffice it to say, however, that this type of dispenser also includes a body 41 and a dispensing nozzle or valve 42. A crank arm 43 is employed and a threaded rod 45 is disposed on the longitudinal axis of the dispensing unit and carries a pressure plate 46. The arm 43 is connected to the rod 45 by a ratchet-gear arrangement so that turning of the handle will cause the rod 45 to rotate about its axis and draw the pressure plate 46 down toward the bottom of the dispenser and cartridge. The cartridge 50 is inserted over the rod 45, following which the pressure plate 46 is applied and the top cap is also applied.

FIG. 8 illustrates the modified cartridge embodying the features of the present invention and usable on either of the dispensers 10 or 40.

It will be noted here that the cartridge 50 is again an elongate cylindrical container having a bottom wall 52 and being closed off with a top cap 51 having thin reinforcing ribs 51*a*. The bottom wall 52, however, has a knock-out portion 53 which is joined to the wall 52 by a reduced thickness web 54. Furthermore, the bottom wall 52 is joined to the cartridge 50 by reduced thickness web 55 about its periphery and adjacent the sidewall.

Accordingly, in utilization of this version of the invention, it is merely necessary, when manufacuring the container, to form it to the configuration shown in FIG. 8, fill it with the material M, and close it with the cover 51.

When it is desired to utilize the cartridge in a dispenser such as the dispenser 40 of FIG. 7, it is merely necesssary to remove the top cap 51 and punch out the central portion 53. The cartridge can then be slipped down over the rod 45 and the pressure plate 46 can be threaded onto the rod to bear against the material M. The dispenser closure 44 is then threaded to the projecting top of the rod and operation of the crank 43 will permit the material M to be dispensed to the dispensing nozzle 42.

It will be noted, however, that a cartridge such as the cartridge 50 would also be suitable for use on a dispenser such as that illustrated in FIGS. 1 and 2. In that instance, the knock-out plug 53 would be maintained intact and the web 55 would be cut so that the bottom member 52 would serve as the pressure plate in a dispenser such as illustrated in FIGS. 1, 2, and 4. Therefore, a device of this type has greatly enhanced useability, due to the fact that the cartridge can be selectively used on either of two well-known dispensers.

Stated otherwise, if cartridge 50 were cut at 55 in the same way cartridge 30 is cut at 32*a*, it is readily apparent that it could be used in place of cartridge 30 in FIG. 4.

While a full and complete description of the invention has been set forth in accordance with the dictates of the Patent Statutes, it should be understood that modifications can be resorted to without departing from the spirit hereof or the scope of the appended claims.

Figure 6:
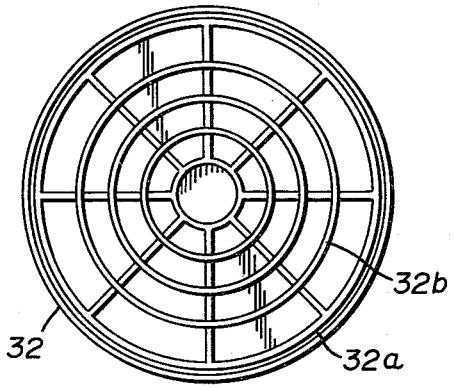
FIG. 6 is a view taken along the lines 6—6 of FIG. 3.

Thus, it ought to be noted that FIG. 6 illustrates the combined bottom wall-pressure plate 32 as having a plurality of ribs 32*b* on its outer surface. Those ribs could be eliminated or greatly reduced in number if desired, in order to facilitate printing of instructions or advertising material on the normally exposed surface thereof.

What is claimed is:

1. A two-piece cartridge for storage and transportation of a fluid and use with a dispensing device of the type which includes a cartridge receiving body and a vacum inducing pump in fluid communication with the cartridge receiving body for drawing material from the cartridge, comprising:

(A) an elongate body having a side wall and first and second ends;

(B) an integral one-piece bottom wall detachably connected to said side wall by a peripherally extending reduced thickness web and normally closing off said first end;

(C) a top cap removably receivable on said second end and normally disposed in sealing relationship therewith;

(D) said second end being receivable on the cartridge receiving body of the dispenser when said top cap is removed;

(E) said bottom wall having a diameter less than the internal diameter of said body, freely resting on the fluid contents of said cartridge in spaced relationship with the sidewall of said body upon being detached from said first end of said wall; and (F) said top cap being receivable on said first end in air permeable relationship thereto when said cartridge is received on the cartridge receiving body of the dispenser.

2. A two-piece cartridge for the storage and transportation of a fluid and use with a dispensing device of the type which includes a cartridge receiving body, a dispensing nozzle in fluid communication with the cartridge receiving body, and a gear driven pressure plate for forcing the fluid through the nozzle, comprising:

(A) an elongate body having a side wall and first and second ends;

(B) a top cap removably receivable on said second end and normally disposed in sealing relationship therewith;

(C) said second end being receivable on the cartridge receiving body of the dispenser when said top cap is removed; and (D) an integral one-piece bottom wall normally closing off said first end of said body and being detachably connected to said side wall by a peripherally extending reduced thickness web and having a removable central portion joined to the remainder of said bottom wall by a concentric reduced thickness web and having a diameter slightly greater than the diameter of the pressure plate of the dispenser whereby said gear driven pressure plate may contact the fluid.

3. A two-piece cartridge for storage and transportation of a fluid and use with a dispensing device which includes a cartridge receiving body and a pump in fluid communication with the cartridge receiving body, comprising:

(A) an elongate body having a side wall and first and second ends;

(B) an integral one-piece bottom wall detachably connected to said side wall adjacent said first end by a peripherally extending reduced thickness web and having a removable central portion joined to the remainder of said bottom wall by a concentric reduced thickness web;

(C) said bottom wall supporting the fluid during storage and transportation;

(D) said bottom wall having a diameter less than the internal diameter of said body and adapted to freely rest on the fluid contents in spaced relationship with the side wall of said body when said cartridge is disposed on the cartridge receiving body of the dispensing device and when detached from said side wall;

(E) a top cap removably receivable on said second end during storage and transportation and normally disposed in sealing relationship therewith, and;

(F) said second end being receivable on the cartridge receiving body of the dispenser when said top cap is removed.

* * * * *